US008632142B2

(12) United States Patent
Park et al.

(10) Patent No.: US 8,632,142 B2
(45) Date of Patent: Jan. 21, 2014

(54) UNDERMOUNT-TYPE SLIDING APPARATUS EQUIPPED WITH AUTOMATIC CLOSING DEVICE

(75) Inventors: Yoon Sik Park, Seoul (KR); Hyun Ho Cha, Goyang-Si (KR)

(73) Assignee: Segos Co., Ltd., Incheon (KR)

( * ) Notice: Subject to any disclaimer, the term of this patent is extended or adjusted under 35 U.S.C. 154(b) by 163 days.

(21) Appl. No.: 13/319,335

(22) PCT Filed: Aug. 3, 2010

(86) PCT No.: PCT/KR2010/005087

§ 371 (c)(1),
(2), (4) Date: Nov. 7, 2011

(87) PCT Pub. No.: WO2011/016660

PCT Pub. Date: Feb. 10, 2011

(65) Prior Publication Data

US 2012/0063710 A1 Mar. 15, 2012

(30) Foreign Application Priority Data

Aug. 7, 2009 (KR) ..... 10-2009-0072999
Dec. 2, 2009 (KR) ..... 10-2009-0118571

(51) Int. Cl.
*A47B 95/00* (2006.01)

(52) U.S. Cl.
USPC ..... 312/333; 312/334.6

(58) Field of Classification Search
USPC ..... 312/333, 319.1, 330.1, 334.44, 334.46, 312/334.47, 334.6
See application file for complete search history.

(56) References Cited

U.S. PATENT DOCUMENTS 5,364,179 A * 11/1994 Brustle et al. ..... 312/333
5,474,375 A * 12/1995 Hollenstein et al. ..... 312/319.1
6,953,233 B2 * 10/2005 Lam et al. ..... 312/333

(Continued)

FOREIGN PATENT DOCUMENTS

JP 2005-230468 A 9/2005
KR 10-0473100 B1 3/2005

(Continued)

OTHER PUBLICATIONS

Search Report for PCT/KR2010/005087.

(Continued)

*Primary Examiner* — Darnell Jayne
*Assistant Examiner* — Kimberley S Wright
(74) *Attorney, Agent, or Firm* — The PL Law Group, PLLC

(57) ABSTRACT

A undermount-type sliding apparatus having an automatic closing device includes a movable rail provided under a receptacle and a fixed rail slidably coupled to the movable rail. A housing body is disposed on the fixed rail. A guide wall includes a curved guide portion, which has a curved shape and is spaced apart from one end of a housing space. A linear guide portion is connected to the curved guide portion. A rotary stopper is inserted into and guided by the guide wall while being caught by and released from the movable rail. An elastic member is disposed in the housing body, and is elastically coupled to the rotary stopper. In a closing operation, the rotary stopper catches the movable rail, and is thus automatically closed by elasticity. When positioned in the opening direction, the movable rail is released from the rotary stopper to enable an opening operation.

6 Claims, 4 Drawing Sheets

(56) References Cited

U.S. PATENT DOCUMENTS

| | | | | |
|---|---|---|---|---|
| 7,028,370 | B2 * | 4/2006 | Hoshide et al. | 16/96 R |
| 7,077,487 | B2 * | 7/2006 | Yang | 312/333 |
| 7,374,260 | B2 * | 5/2008 | Lu | 312/333 |
| 7,399,041 | B2 * | 7/2008 | Prentner et al. | 312/333 |
| 7,472,973 | B2 * | 1/2009 | Huang | 312/333 |
| 8,182,054 | B2 * | 5/2012 | Liang et al. | 312/333 |
| 8,240,788 | B2 * | 8/2012 | Juan et al. | 312/333 |
| 8,414,094 | B2 * | 4/2013 | Chi et al. | 312/333 |
| 2005/0093406 | A1 * | 5/2005 | Yang | 312/333 |
| 2006/0137137 | A1 * | 6/2006 | Hoshide et al. | 16/96 R |
| 2007/0132346 | A1 * | 6/2007 | Huang | 312/333 |
| 2007/0278917 | A1 * | 12/2007 | Yang | 312/330.1 |
| 2007/0278919 | A1 * | 12/2007 | Lu | 312/333 |
| 2009/0121596 | A1 * | 5/2009 | Ferrari | 312/334.8 |
| 2009/0160299 | A1 * | 6/2009 | Chen et al. | 312/334.44 |
| 2009/0195131 | A1 * | 8/2009 | Chi et al. | 312/319.1 |
| 2010/0123378 | A1 * | 5/2010 | Chen et al. | 312/333 |
| 2011/0037362 | A1 * | 2/2011 | Park et al. | 312/319.1 |
| 2012/0002907 | A1 * | 1/2012 | Rehage | 384/20 |

FOREIGN PATENT DOCUMENTS

| | | | |
|---|---|---|---|
| KR | 10-2008-0077710 | A | 8/2008 |
| KR | 10-2009-0022579 | A | 3/2009 |
| WO | 0182749 | A2 | 11/2001 |

OTHER PUBLICATIONS

English Abstract of JP 2005-230468.
English Abstract of KR 10-2008-0077710.
English Abstract of KR 10-2009-0022579.

* cited by examiner

UNDERMOUNT-TYPE SLIDING APPARATUS EQUIPPED WITH AUTOMATIC CLOSING DEVICE

CROSS REFERENCE TO RELATED APPLICATION AND CLAIM OF PRIORITY

The present application claims all benefits accruing under 35 U.S.C. §365(c) from the PCT International Application PCT/KR2010/005087, with an International Filing Date of Aug. 3, 2010, which claims the benefit of Korean patent application Nos. 10-2009-0072999 filed in the Korean Intellectual Property Office on Aug. 7, 2009 and 10-2009-0118571 filed in the Korean Intellectual Property Office on Dec. 2, 2009, the entire contents of which are incorporated herein by reference.

BACKGROUND

1. Technical Field

The present invention relates to an undermount-type sliding apparatus having an automatic closing device.

2. Background Art

In general, a sliding apparatus refers to an apparatus that enables a drawer-like receptacle, such as a piece of furniture, a refrigerator or a variety of storage boxes, in which a variety of articles is contained, to slide to a closed or open position. The sliding apparatus is disposed on the inner wall side of a space of the body of a piece of furniture, a refrigerator, and boxes, in which the receptacle is housed, and the opposite side of the receptacle such that the receptacle can slide by making rolling contact. The receptacle on which the sliding apparatus is mounted can then be slid on the sliding apparatus in the space of the body so as to be opened or closed, so that items or material can be put in the receptacle. Specifically, the receptacle is connected to the body via the sliding apparatus such that it can smoothly slide on the sliding apparatus that carries out the rolling motion when the receptacle is opened or closed.

A typical undermount-type sliding apparatus is divided into a double-rail structure and a triple-rail structure. The double-rail structure includes movable rails disposed on opposite lower sides of a receptacle, fixed rails on inner wall sides of a body, each of the fixed rails having a plurality of raceways, and sliding member disposed on each raceway to be in rolling contact with a corresponding movable rail, such that the movable rails slide on the sliding member along the raceways. The triple-rail structure further includes an intermediate rail between the fixed mil and the movable rail, the intermediate rail acting as a raceway, such that the movable rail slides along the intermediate rail.

The typical undermount-type sliding apparatus is configured such that the receptacle can be slid to be opened or closed. When a user applies force in a closing direction to close the receptacle, the receptacle slides on the sliding apparatus so that it is inserted into the space of the body and is then closed. At this time, when excessive force greater than that necessary for closing the receptacle is applied, the receptacle collides with the body when it is closed and may be opened again due to the repulsive force of impact that is caused by the collision.

Therefore, currently being worked on is the development of an automatic closing device for the undermount-type sliding apparatus that can automatically close a receptacle using elastic force when the receptacle is to be closed.

An automatic closing device that is provided in a undermount-type sliding apparatus of the related art includes a housing, which is disposed on a fixed rail, a movable member and an elastic member. A damper that smoothens the motion of the movable member may be optionally included. The housing is disposed on the fixed rail in a position where the movable rail ends, and has defined therein a through-hole which guides the movable member. The through-hole has a curved portion, which is formed in an open position of the movable rail, and a linear portion, which is formed in a closed side, connected to the curved portion in the opening position. The movable member is disposed inside the housing in a position where the movable rail is pulled, and moves in the state in which it is inserted into the through-hole. The elastic member is disposed inside the housing such that it elastically supports the movable member.

In the automatic closing device of the related art, the movable member is elastically supported and is positioned on the curved portion of the through-hole in the state of the elastic member being stretched when the receptacle is opened. The motion in the closed receptacle causes the movable rail, which is caught by the movable member, to be pulled by the elastic force of the elastic member, so that the receptacle is automatically closed. When the movable rail is pulled, the movable member moves from the curved portion to the linear portion of the through-hole, and is then guided to move along the linear portion. When the receptacle is operated to open, the movable mil moves toward the curved portion of the through-hole by pulling the movable member, so that the movable rail is released from the caught state, and the movable member is positioned on the curved portion of the through-hole, with the elastic member being stretched.

In addition, in the automatic closing device of the related art, when the receptacle is operated again to be opened after having been automatically closed, the movable rail is pulled by the movable rail of the receptacle and is then positioned to be inserted into the curved portion of the through-hole, and the catching caused by the automatic closing of the receptacle is released by rotation of the movable member. At this time, in the state in which the movable member is not completely inserted into the curved portion of the through-hole, when the receptacle is excessively forced in the opening direction, the movable member may be subjected to collision or clogging at the curved portion inside the through-hole. Consequently, the movable member stops operating at the clogged position or is operated to return to the linear portion instead of being positioned on the curved portion. Even after being operated to return, a state of malfunction in which the movable member refuses to operate again may persist.

The automatic closing device of the related art, which does not operate due to the foregoing malfunction, may be returned to the state in which it can operate again by forced operation of the movable rail. In the forced operation of the movable rail, the through-hole is elastically deformed so that the movable member can be returned to the state in which it can operate again inside the through-hole. In order for the through-hole to be elastically deformed, an elastic deformation hole, which communicates in part with the through-hole, is required. The elastic deformation hole is formed like the through-hole of the housing, and communicates in part with the through-hole. The size of the elastic deformation hole increases when the movable member passes through it, so that the movable member, which malfunctions, can be put in the operable state. When the movable member is positioned in the operable state, the through-hole can return to the original size, since the elastic deformation hole is elastically deformed.

Specifically, when the movable mil is forced toward the automatic closing device, which does not operate in the event of a malfunction, it moves toward the closed position in the state in which it is caught by the movable member, and is returned by elastic deformation from the position of the elastic deformation hole to the original position in which the movable member is operable. After having returned to its original position, the through-hole is returned to the operable size by elasticity, so that the automatic closing device can normally operate.

However, the automatic closing device of the related art has a problem in that its strength is easily decreased due to a fracture that easily occurs at the position of the hole during the operation or by external impact, since the through-hole for guiding the movable member and the elastic deformation hole communicating in part with the through-hole are formed as a hole in the housing and the movable member is inserted into the hole.

In addition, as the movable member is inserted into and moves along the through-hole of the housing so that it is guided by the curved portion and the linear portion, a protrusion is inserted into and moves in contact with the hole. A fracture occurs due to friction with the protrusion, and a pressing force is continuously applied to the hole and the protrusion under the elastic force of the elastic member. Consequently, there are the problems of its shape being deformed and fracturing.

Furthermore, when the automatic closing device malfunctions, it escapes from the malfunctioning position while being elastically deformed at the position where the through-hole communicates with the elastic deformation hole. Therefore, the movable member is elastically deformed while being forcibly transported between the two holes, so that the impact of the elastic deformation is concentrated on a specific portion, which is then deformed and fractures.

SUMMARY

Accordingly, the present invention has been made keeping in mind the above problems occurring in the related art, and is intended to provide a undermount-type sliding apparatus having an automatic closing device, in which a guide structure of the automatic closing device, which closes a undermount-type sliding rail, is changed into a protrusion in order to strengthen its structure, and an operating member, which is guided by the protrusion, is provided with a simple shape that minimizes movement interference depending on the shape of the protrusion, whereby the strengthened structure increases lifespan and minimized friction increases operating efficiency.

An embodiment of the present invention provides an undermount-type sliding apparatus having an automatic closing device. The sliding apparatus includes a movable rail, which is provided under a receptacle, and a fixed rail, which is slidably coupled to the movable rail such that the movable rail is operable to be opened and closed. The sliding apparatus also includes a housing body disposed on one side of the fixed rail. The housing body has defined therein a housing space having open upper and lower portions. The sliding apparatus also includes a guide wall, which includes a curved guide portion partially protruding from one side to the other side in an open interior of the housing body, the curved guide portion extending from a lower end toward a central portion so as to have a curved shape and being spaced apart from one end of the housing space in an opening direction, and a linear guide portion connected to the curved guide portion, the linear guide portion extending in a closing direction to have a linear shape in a central portion of the housing space. The sliding apparatus also includes a rotary stopper, the rotary stopper being positioned so as to be inserted into and guided by the guide wall while being caught by and released from the movable rail, and an elastic member disposed in the housing body in the closing direction, the elastic member being elastically coupled to the rotary stopper. In a closing operation of the movable rail, the rotary stopper is operable to catch the elastic member so that the rotary stopper is automatically closed by elasticity of elastic force. When the rotary stopper is positioned in the opening direction, the opening direction of the rotary stopper moves downward along the curved guide portion in a state in which the elastic member stays in a stretched state, so that the movable rail is released from the rotary stopper to enable an opening operation.

In addition, the rotary stopper has a guide insert recess in an inner portion thereof. The guide insert recess is inserted into the guide wall such that the guide insert recess is guided by the guide wall. The guide insert recess has an opening contact surface and a curved contact surface above the guide wall inserted into the guide insert recess, wherein in an opened state, the opening contact surface is in contact with the linear guide portion, and the curved contact surface corresponds to the curved guide portion so as to come into contact with the curved guide portion. The guide insert recess has a closing contact surface below the guide wall inserted into the guide insert recess, the closing contact surface coming into contact with the linear guide portion in a closed state. Accordingly, when closing the receptacle, the rotary stopper, which moves in the state in which the guide wall is inserted into the rotary stopper, can be released in response to rotation of the opening contact surface in contact with the linear guide portion and the curved contact surface in contact with the curved guide portion, so that the closing contact surface below moves in contact with a lower portion of the linear guide portion. In addition, when opening the receptacle, the rotary stopper can be caught in response to rotation of the opening contact surface in contact with the linear guide portion and the curved contact surface in contact with the curved guide portion.

Furthermore, the sliding apparatus further includes an elastic body disposed in the housing body in the closing direction. The elastic body has an elastic member insert space in a lower inner portion, the elastic body being positioned in the elastic member insert space, and an elastic member-fixing recess in one end of the elastic member insert space in the closing direction, the other end of the elastic member being fixed to the elastic member-fixing recess.

In addition, the sliding apparatus further includes an elastic member-fixing protrusion protruding from a lower portion of the rotary stopper in the closing direction. The elastic member-fixing protrusion has a protrusion-fixing recess in an inner portion thereof. A portion of the elastic body is fixedly inserted into the elastic member-fixing protrusion. One end of the elastic member is inserted into the protrusion-fixing recess such that the rotary stopper can be elastically coupled to the elastic member-fixing protrusion.

Furthermore, the rotary stopper has a catching recess in an upper portion thereof and an inclined surface in the opening direction. The inclined surface is inclined from an upper side portion of the rotary stopper to a side surface of the catching recess. The apparatus further includes a stopping lug disposed on the movable rail, the stopping lug protruding downward such that the stopping lug can be inserted into and caught by the stopper recess. The inclined surface passes by an inclined position to minimize insertion interference when the stopping lug is caught by and coupled to the stopper recess. The stopping lug is movable along with the movable rail so that the stopping lug is inserted into and released from the stopper recess.

In addition, the housing body has a through-hole in a position where a portion of the guide wall is exposable to an outside. Accordingly, the guide wall exposed to the outside through the through-hole is elastically deformable by external force inside a space of the guide wall.

According to embodiments of the present invention, the receptacle is disposed such that it slides on the fixed rail, which is fixed to the body, and a movable stopper that is designed to be automatically closed by being caught by and releasing from the movable rail, which is fixed to the receptacle. This provides a stable structure compared to the through-hole type, thereby providing the effect of a longer lifespan.

In addition, the elastic member that generates elastic force to enable the automatic closing is provided, and the movable stopper is configured such that it can be caught by and released from the movable rail by the rotation movable stopper in the opening direction of the guide wall. Consequently, the operations of catching and releasing the movable rail and the movable stopper can be efficiently and correctly performed, thereby advantageously reducing malfunctions.

Furthermore, the movable stopper is configured such that it can come into face contact with the guide wall on which the elastic member can be supported in the linear form in the event of automatic closing and in the curved form in the event of opening. Even though tension is applied, the movable stopper can be prevented from being dislodged from the position in which it is supported on the guide wall, thereby decreasing malfunctions.

Moreover, the guide wall has the elastically-deformable through-hole so that it can return to its original state in the event of a malfunction when the movable stopper is moving guided along the guide wall. Thus, the guide wall that has the form of a protrusion is elastically deformed and returns to its original state in the event of a malfunction, thereby increasing strength compared to the elastic deformation structure in which the through-hole is partially connected. In addition, as the protruding wall is elastically deformed, the performance of returning is improved.

Figure 1:
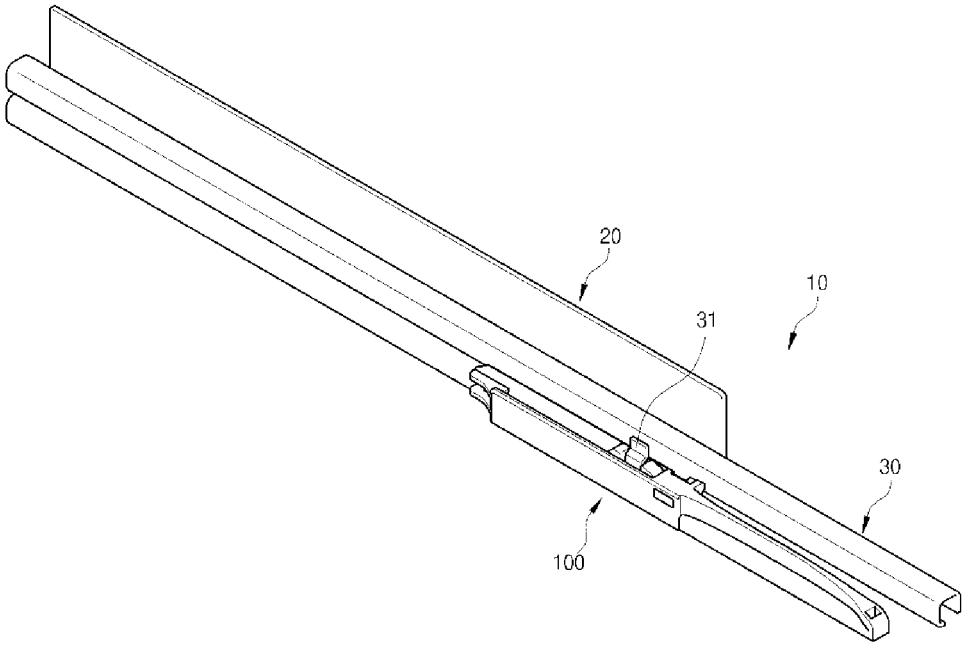
FIG. 1 is a perspective view showing an undermount-type sliding apparatus having an automatic closing device according to an embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience

DETAILED DESCRIPTION

Hereinafter embodiments of the present invention will now be described in detail with reference to the accompanying drawings, so that a person having ordinary skill in the art to which the present invention relates can easily put the present invention into practice. It should be understood, however, that the present invention is not limited to the embodiments disclosed herein, but can be embodied in various different forms. Throughout this document, the same reference numerals and signs are used throughout the different drawings to designate the same or similar components.

A description will be given below of an undermount-type sliding apparatus having an automatic closing device according to an embodiment of the present invention with reference to FIG. 1.

FIG. 1 is a perspective view showing an undermount-type sliding apparatus having an automatic closing device according to an embodiment of the present invention.

Referring to FIG. 1, the sliding apparatus 10 having an automatic closing device according to an embodiment of the present invention includes a fixed rail 20, a movable rail 30 and an automatic closing device 100.

In the undermount-type sliding apparatus 10, only the fixed rail and the movable rail 30 are shown, but a sliding member and a raceway on which the sliding member can be disposed are omitted. The sliding apparatus 10 may use both a double-rail structure which is disposed on the fixed rail and a triple-rail structure which has an intermediate structure having a raceway. That is, it is apparent to a person having ordinary skill in the art that a device that can slide is disposed between the movable rail and the fixed rail even though the sliding member and the device that supports the sliding member are omitted.

The fixed rail is fixed to the inner wall in which a receptacle is intended to be positioned, and supports the receptacle such that the receptacle can slide.

The movable rail 30 is disposed on both sides of the lower portion of the receptacle, and is slidably coupled with the fixed rail 20 to move in the directions of opening and closing together with the receptacle. The movable mil 30 has a stopping lug 31 on one side thereof, the stopping lug 31 protruding downwards. The stopping lug 31 protrudes downward such that it can be caught by and released from the automatic closing device 100 when the movable rail 30 moves in the opening and closing directions. That is, the stopping lug 31 can be automatically closed because it is caught by and released from the automatic closing device 100 because of the operation of the receptacle.

A description will be given of the automatic closing device 100 with reference to FIG. 2 to FIG. 5.

Figure 2:
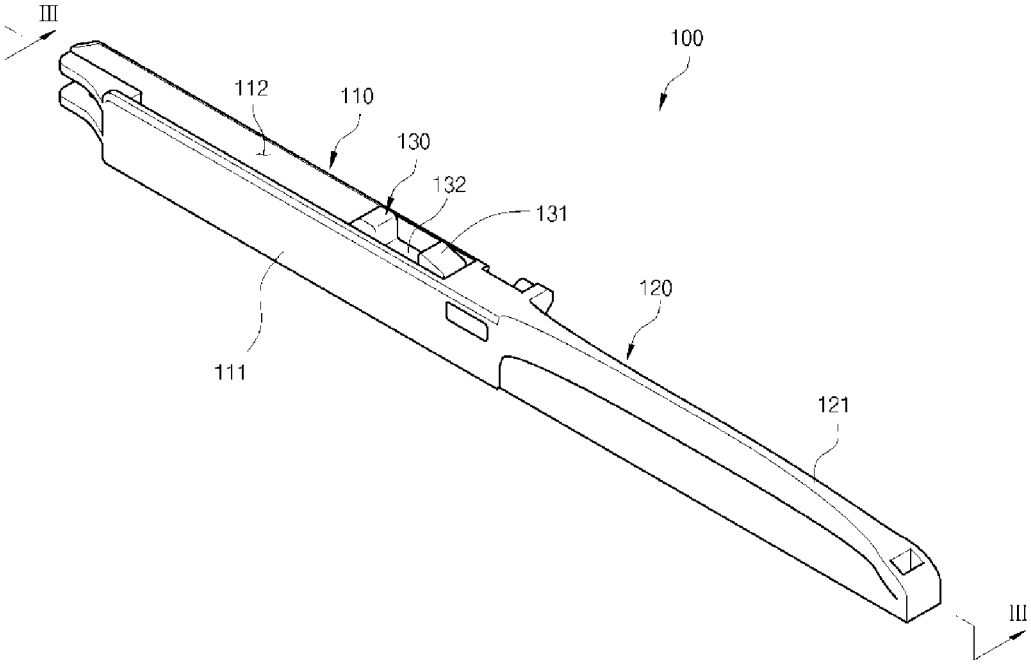
FIG. 2 is a perspective view showing the automatic closing device of the undermount-type sliding apparatus shown in FIG. 1.
Figure 3:
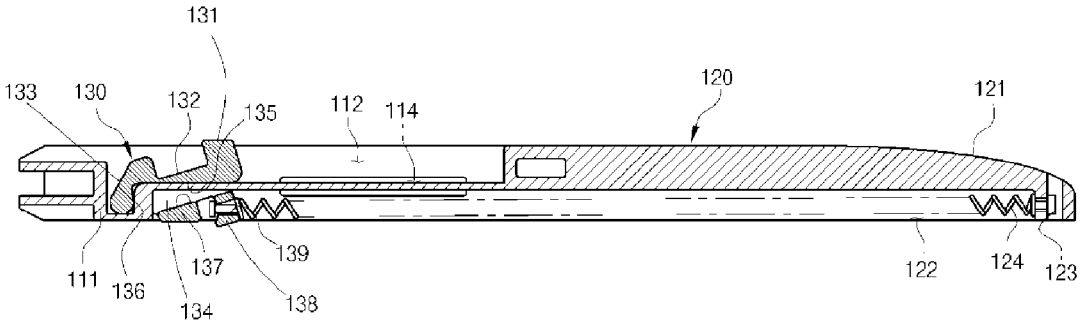
FIG. 3 is a cross-sectional view taken along line III-III in FIG. 2.
Figure 4:
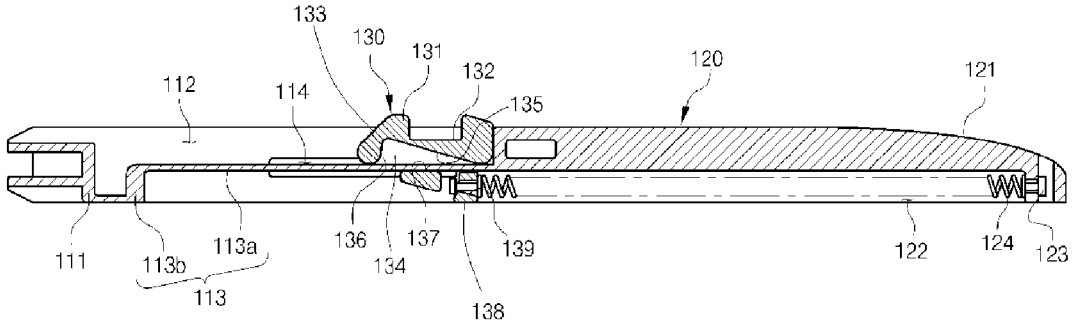
FIG. 4 is a cross-sectional view showing an opened state of the automatic closing device shown in FIG. 3.
Figure 5:
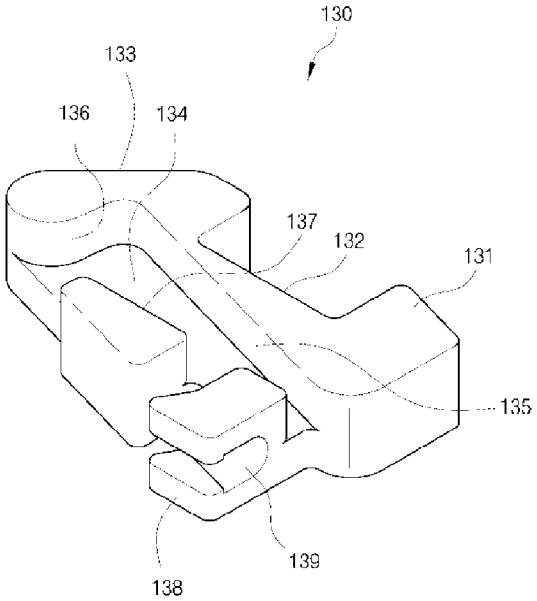
FIG. 5 is a rear perspective view showing the rotary stopper body of the automatic closing device shown in FIG. 2.

FIG. 2 is a perspective view showing the automatic closing device of the undermount-type sliding apparatus shown in FIG. 1, FIG. 3 is a cross-sectional view taken along line III-III in FIG. 2, FIG. 4 is a cross-sectional view showing an opened state of the automatic closing device shown in FIG. 3, and FIG. 5 is a rear perspective view showing the rotary stopper body of the automatic closing device shown in FIG. 2.

Referring to FIG. 2 to FIG. 5, the automatic closing device 100 includes a housing 110, an elastic portion 120 and a rotary stopper 130. A housing body 111 is disposed on one side of the fixed rail 20, and is positioned below the stopping lug 31. The housing body 111 is disposed on one side of the fixed rail 20, and can be fixed to a lower position where the stopping lug 31 can be caught or released. A housing space 112 is formed inside the housing body 111, extending through the housing body 111 such that the upper and lower portions are open. The rotary stopper 130 is disposed in the housing space 112, and can automatically close the receptacle by being locked to and released from the stopping lug 31. The housing body 111 has a through-hole 114 in the center thereof, the through-hole 114 extending toward the fixed rail 20 such that it communicates with the housing space 112.

In the central portion inside the housing space 112, a guide wall 113 protrudes outward from the fixed rail 20. The size of the guide wall 113 is suitable for the rotary stopper 130 to be inserted into and guided by the guide wall 113. The guide wall 113 has a linear guide portion 113*a* and a curved guide portion 113*b*. The linear guide portion 113*a* extends from the end of the closing direction toward the opening direction, and is spaced at a predetermined interval from the housing body 111. The curved guide portion 113*b* is formed on one end of the linear guide portion 113*a* configured as described above and is bent downward along a curve. The guide wall 113 is configured such that it can guide the rotary stopper 130 which is inserted into it. The rotary stopper 130 is caught by the curved guide portion 113*b* in the state of being inserted into the guide wall 113 when the receptacle is opened. When the receptacle is closed, the rotary stopper 130 can be automatically closed while being transported on the linear guide portion 113*a* after being released from the curved guide portion 113*b*.

In addition, the guide wall 113 is disposed in the central portion in which the through-hole 114 is formed such that the linear guide portion 113*a* can be elastically deformed by external force inside the through-hole 114. If a malfunction occurs while the rotary stopper 130 is moving along the guide wall 113, the movable rail 30 is forced to a closing position. Due to external force applied to the rotary stopper 30 that is caught by and moved by the stopping lug 31 following the forced displacement of the movable rail 30, the guide wall 113 that guides the rotary stopper 130 is elastically deformed inside the through-hole 114. When the guide wall 113 is elastically deformed, the rotary stopper 130 that has been displaced from its operation position because of a malfunction moves to the original position, thereby rendering normal operation possible. Accordingly, as the guide wall 113 is elastically deformed inside the through-hole 114 due to the forced closing operation, the rotary stopper 130 can be displaced from the malfunctioning position to the operable position, thereby facilitating maintenance.

The elastic portion 120 has an elastic member 124 and an elastic body 121. The elastic body 121 is arranged in the closing direction of the housing body 111, and the elastic member 124 is arranged in the closing direction of the housing body 111 and is provided in the lower portion thereof with an elastic member insert space 122 that is opened in the opening direction. The elastic member insert space 122 is opened in the opening direction such that it communicates with the housing space 112. In addition, an elastic member-fixing recess 123 is formed in one end of the elastic member insert space 122 in the closing direction.

The elastic member 124 is arranged inside the elastic body 121, and is positioned inside the elastic member insert space 122. One end of the elastic member 124 is fixed inserted into the elastic member-fixing recess 123, and the other end of the elastic member 124 is positioned inside the housing space 112 that communicates with the lower portion of the guide wall. The elastic member 124 can extend from the closing direction to the opening direction, and the other end of the elastic member, which is positioned inside the housing space 112, is fixed such that elastic force is applied to the rotary stopper 130 from below in the closing direction.

The rotary stopper 130 includes a rotary stopper body 131 that is positioned inside the housing body 111 and an elastic member-fixing protrusion 138. The rotary stopper body 131 is disposed inside the housing space 112, and has a catching recess 132 in the upper portion thereof. The stopping lug 31 can be caught by and released from the catching recess 132. A guide insert recess 134 is formed inside the rotary stopper body 131, and is opened toward the fixed rail 20 such that the guide wall 113 is inserted into the guide insert recess 134.

In the rotary stopper body 131, in the state in which the receptacle is opened, the guide insert recess 134 is fixedly inserted into the curved guide portion 113*b* along the curvature so that the opening direction of the catching recess 132 is opened after being displaced downward. As the receptacle is being closed, the stopping lug 31 is caught by the catching recess 132 while moving in the closing direction so that the rotary stopper body 131 rotates in the closing direction. Here, while the rotary stopper body 131 is moving from the curved guide portion 113*b*, which is inserted into the guide insert recess 134, to the linear guide portion 113*a* of the guide wall 113, the opening direction of the catching recess 132, which is inclined, rises to a position where the stopping lug 31 is then inserted into the catching recess 132.

When the receptacle moves again in the opening direction after being closed, the stopping lug 31 inserted into the catching recess 132 moves in the opening direction. Here, the stopping lug 31 moves in the opening direction together with the rotary stopper body 131. The rotary stopper body 131 moves in the opening direction while being guided along the guide wall 113 inserted into the guide insert recess 134. When the rotary stopper body 131 reaches the curved guide portion 113*b* of the guide wall 113 after having moved in the opening direction, the rotary stopper body 131 rotates along the curved guide portion 113*b* and is inclined to descend in the opening direction of the catching recess 132. The opening direction of the catching recess 132 is opened due to the descent so that the stopping lug 31 can move in the opening direction. Consequently, the movable rail 30 can move in the opening direction.

The guide insert recess 134 is configured such that it can be inserted and supported along the shape of the guide wall 113 that has the linear guide portion 113*a* and the curved guide portion 113*b*. The guide insert recess 134 into which the guide wall 113 is inserted has an opening contact surface 135 above the guide wall 113. The opening contact surface 135 comes into contact with the linear guide portion 113*a* when the receptacle is opened. A curved contact surface 136 is formed at the end of the opening direction of the guide insert recess 134, and depending on the shape of the curved guide portion 113*b* that is curved downward, comes into contact with the curved guide portion 113*b* in the opened state so that the rotary stopper body 131 can be inserted into and supported by the curved contact surface 136.

The guide insert recess 134 has a closing contact surface 137 below the guide wall 113, and is spaced apart from the curved contact surface 136. The closing contact surface 137 comes into contact with the underside of the guide wall 113 during the closing operation of the receptacle. When the receptacle is opened, the guide insert recess 134 is inclined downward such that the opening direction of the catching recess 132 can be opened, and is fixed in contact with the curved contact surface 136 and the opening contact surface 135. In the closing operation of the receptacle, as the stopping lug 31 is caught by the catching recess 132, the guide insert recess 134 is rotated so as to raise the opening direction so that the curved surface 136 and the opening contact surface 135 are separated from the guide wall due to the rising. The closing contact surface 137 moves in the closing direction in contact with the lower portion of the guide wall 113.

The elastic member-fixing protrusion 138 protrudes from the lower portion of the rotary stopper body 131 in the closing direction, and has a protrusion-fixing recess 139 in the central portion thereof, the elastic member 124 being fixed to the protrusion-fixing recess 139. The other end of the elastic member 124, which is positioned in the lower portion of the guide wall 113 inside the housing space 112, is fixed inserted into the protrusion-fixing recess 139. The elastic member 124 is elastically coupled to the protrusion-fixing recess 139, which is in the lower portion of the rotary stopper in the closing direction, such that elastic tensile force can be applied to the lower portion of the rotary stopper body 131 in the closing direction. The elastic member-fixing protrusion 138 protrudes from the lower portion of the rotary stopper body 131 in the closing direction so that the elastic force of the elastic member 124 generates a pulling force in the closing direction. The center of the rotary stopper body 131, which is inserted into the guide wall 113, is positioned higher than the position to which the elastic force of the elastic member 124 is applied. Thus, due to the different centers, rotational force is generated in the downward direction toward the end of the opening direction.

When the receptacle moves in the closing direction, the stopping lug 31 is caught by the catching recess 132, and thus displaces the rotary stopper body 131 in the closing direction, thereby releasing the fixed state. The rotary stopper body 131, having been released from the fixed state, is automatically moved to the closing position by the restoring force of the elastic member 124.

When the receptacle moves to the opening position after having been closed, the rotary stopper body 131 is guided by the linear guide portion 113*a* of the guide wall 113 so as to be positioned on the curved guide portion 113*b*. Rotation of the rotary stopper body 131 is then induced, and thus the curved contact surface 136 comes into contact with and is fixed to the curved guide portion 113*b*.

A description will be given below of the operation of the undermount-type sliding apparatus having an automatic closing device according to an embodiment of the present invention with reference to FIG. 6 to FIG. 9.

Figure 6:
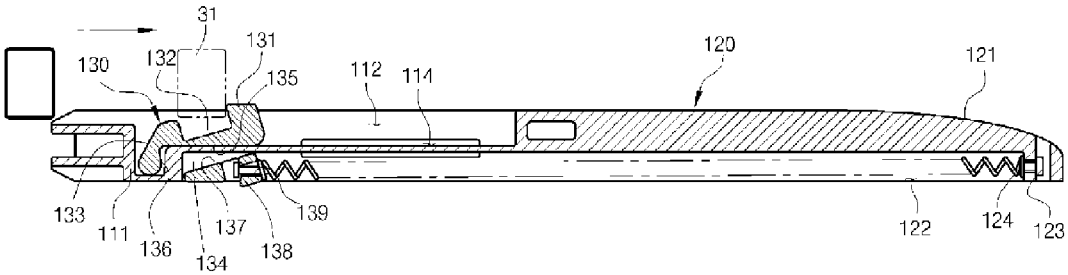
FIG. 6 is an operational view showing the undermount-type sliding apparatus having an automatic closing device shown in FIG. 1, which is being opened from closed state.
Figure 7:
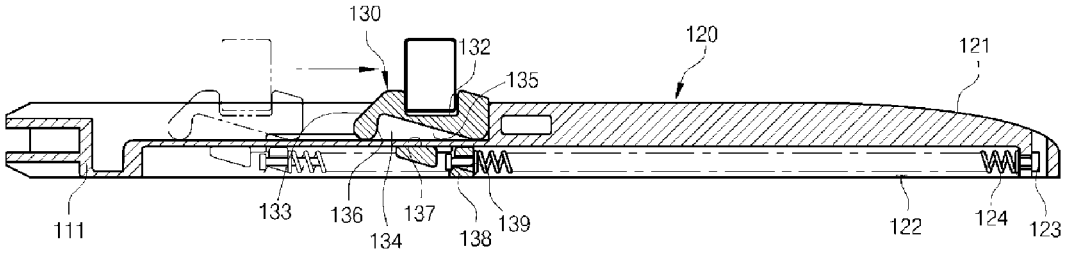
FIG. 7 is an operational view showing the undermount-type sliding apparatus having an automatic closing device shown in FIG. 1, which is in opened state.
Figure 8:
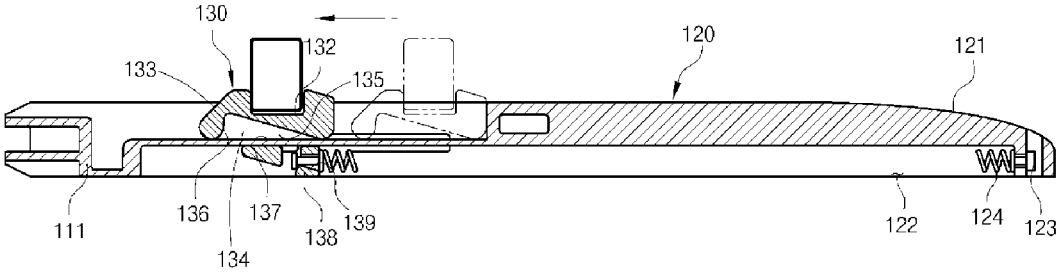
FIG. 8 is an operational view showing the undermount-type sliding apparatus having an automatic closing device shown in FIG. 1, which is being closed.

FIG. 6 is an operational view showing the undermount-type sliding apparatus having the automatic closing device shown in FIG. 1, which is being opened from closed state. FIG. 7 is an operational view showing the undermount-type sliding apparatus having the automatic closing device shown in FIG. 1, which is in an opened state. FIG. 8 is an operational view showing the undermount-type sliding apparatus having the automatic closing device shown in FIG. 1, which is being closed. And, FIG. 9 is an operational view showing the undermount-type sliding apparatus having the automatic closing device shown in FIG. 1, which is being automatically closed.

Referring to FIG. 6 and FIG. 7, when the receptacle is displaced from an open position to a closed position, the stopping lug 31 moves toward the catching recess 132 that is inclined such that the opening position of the rotary stopper body 131, which is fixed to the stretched elastic member 124, descends. When the stopping lug 31 comes into contact with the catching recess 132, the rotary stopper body 131, which is inserted into the guide insert recess 134, moves along the curved guide portion 113*b* of the guide wall 113. Once the rotary stopper body 131 has moved, it automatically moves in the closing direction along the linear guide portion 113*a* of the guide wall 113 due to the restoring force of the stretched elastic member 124, thereby automatically closing the receptacle.

Figure 9:
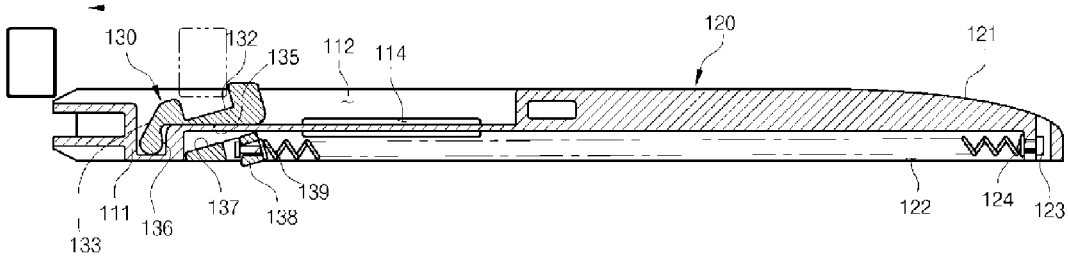
FIG. 9 is an operational view showing the undermount-type sliding apparatus having an automatic closing device shown in FIG. 1, which is being automatically closed.

Referring to FIG. 8 and FIG. 9, the displacement of the receptacle, which had been closed, to the open position causes the rotary stopper body 131 having the catching recess 132 into which the stopping lug 31 is inserted to move along the linear guide portion 113*a* of the guide wall 113 in the opening direction. When the moving rotary stopper body 131 reaches the position of the curved guide portion 113*b* of the guide wall 113, the rotary stopper body 131 is rotated and moves such that the opening position is inclined to a lower position along the curved surface of the curved guide portion 113*b* of the rotary stopper body 131, thereby opening an opening portion of the catching recess 132.

At this time, the elastic force of the elastic member 124, which is positioned below in the closing direction, imparts a rotational force to the rotary stopper body 131 so that the opening direction of the rotary stopper body 131 can move to a lower position. The rotational force acts so that the rotary stopper body 131 can be easily inserted between the curved guide portion 113*b* and the housing body 111 depending on the curvature of the curved guide portion 113*b*, which is inserted into the guide insert recess 134.

The receptacle is manipulated to be opened by the stopping lug 31 which moves in the opening direction in which the catching recess 132 is opened. Due to the elastic force of the elastic member 124, it automatically moves to the closing position in the closing operation, and its catching is released due to rotation in the opening operation. This consequently increases the efficiency of the operation of opening and closing the receptacle.

Figure 10:
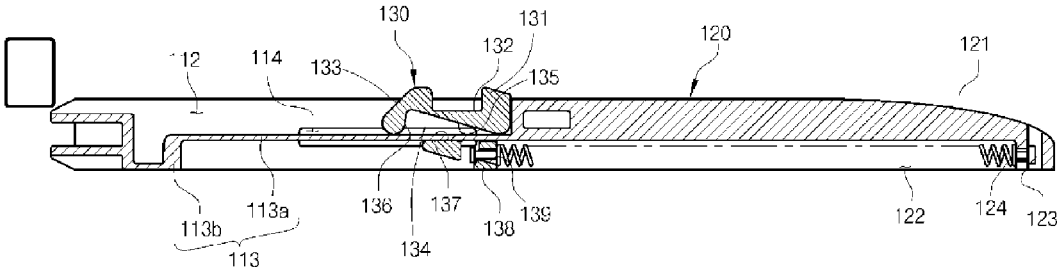
FIG. 10 is an operational view showing the undermount-type sliding apparatus having an automatic closing device shown in FIG. 1, which has malfunctioned.

The automatic closing device that operates as above may malfunction as shown in FIG. 10.

When the receptacle is in the opened state, the rotary stopper body 131 is positioned in the curved guide portion 113*b* of the guide wall 113, and the elastic member 124 stays in the stretched state. Here, in the event of external impact or when the rotary stopper body 131 is not completely inserted into the curved guide portion 113*b*, in the state in which the stopping lug 31 is not coupled via catching by the elastic force of the stretched elastic member 124, i.e. the receptacle is opened, the rotary stopper body 131 moves in the closing direction. The movement of the rotary stopper body 131 in this way causes the malfunctioning state, in which the automatic closing operation is not performed even in a position where the receptacle is intended to be automatically closed.

Figure 11:
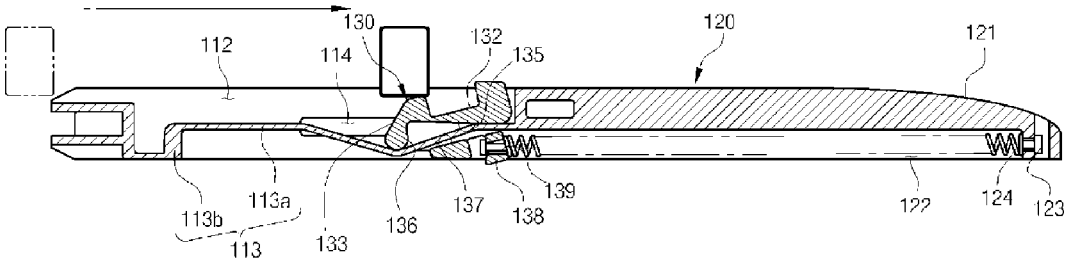
FIG. 11 is an operational view showing the undermount-type sliding apparatus having an automatic closing device shown in FIG. 1, which is returning to its original state after having malfunctioned.

The above-described malfunctioning state can return to its original state by forcibly closing the receptacle, as shown in FIG. 11

In the state in which the rotary stopper body 131 is positioned on the linear guide portion 113*a* of the guide wall 113 in the closing direction, when the receptacle is forcibly closed, the stopping lug 31 moves to the position of the rotary stopper body 131. When the stopping lug 31 reaches the position of the rotary stopper body 131, it is inserted into the catching recess 132 because of contact made with an inclined surface 133 in the opening direction. Here, the linear guide portion 113*a* of the guide wall 113 into which the rotary stopper body 131 is inserted is provided in the form of a bar that is not fixed by the through-hole 114 and thus can be elastically deformed. Specifically, when the stopping lug 31 comes into contact with the inclined surface 133, a force that presses down the rotary stopper body 131 occurs, and the linear guide portion 113*a* of the guide wall 113, which is formed in the position of the through-hole 114, descends due to the elastic deformation, and the stopping lug 31 is coupled to the catching recess 132 via catching. In the state in which the stopping lug 31 is coupled via catching to the catching recess 132 formed in the upper portion of the rotary stopper body 131, when the receptacle is displaced in the opening direction, the rotary stopper body 131 can be inserted again into the curved guide portion 113*b*, thereby returning the rotary stopper body 131 to the original state in which the elastic member 124 is stretched, and from which the automatic closing can be carried out.

While the present invention has been shown and described with reference to the certain exemplary embodiments thereof, various changes in forms and details will be apparent to those skilled in the art without departing from the spirit and scope of the present invention as defined by the appended claims and their equivalents.

In the present invention, the automatic closing device is provided in the sliding apparatus that enables the drawer-like receptacle, such as a piece of furniture, a refrigerator or a variety of storage boxes, to slide. The structure of the automatic closing device is simplified and intensified and minimizes friction, thereby lengthening the lifespan of the sliding apparatus.

According to embodiments of the present invention, the receptacle is disposed such that it slides on the fixed rail, which is fixed to the body, and a movable stopper that is designed to be automatically closed by being caught by and releasing from the movable rail, which is fixed to the receptacle. This provides a stable structure compared to the through-hole type, thereby providing the effect of a longer lifespan.

In addition, the elastic member that generates elastic force to enable the automatic closing is provided, and the movable stopper is configured such that it can be caught by and released from the movable rail by the rotation movable stopper in the opening direction of the guide wall. Consequently, the operations of catching and releasing the movable rail and the movable stopper can be efficiently and correctly performed, thereby advantageously reducing malfunctions.

Furthermore, the movable stopper is configured such that it can come into face contact with the guide wall on which the elastic member can be supported in the linear form in the event of automatic closing and in the curved form in the event of opening. Even though tension is applied, the movable stopper can be prevented from being dislodged from the position in which it is supported on the guide wall, thereby decreasing malfunctions.

Moreover, the guide wall has the elastically-deformable through-hole so that it can return to its original state in the event of a malfunction when the movable stopper is moving guided along the guide wall. Thus, the guide wall that has the form of a protrusion is elastically deformed and returns to its original state in the event of a malfunction, thereby increasing strength compared to the elastic deformation structure in which the through-hole is partially connected. In addition, as the protruding wall is elastically deformed, the performance of returning is improved.

The invention claimed is:

1. An undermount-type sliding apparatus, comprising:

a movable rail provided under a receptacle;

a fixed rail slidably coupled to the movable rail such that the movable rail is operable to be opened and closed; and an automatic closing device comprising:

a housing body disposed on one side of the fixed rail, the housing body having a housing space having an open upper portion and a lower portion;

a guide wall comprising:

a curved guide portion partially protruding from one side to the other side in an open interior of the housing body, the curved guide portion extending from a lower end toward a central portion so as to have a curved shape and being spaced apart from one end of the housing space in an opening direction; and a linear guide portion connected to the curved guide portion, the linear guide portion extending in a closing direction to have a linear shape in a central portion of the housing space;

a rotary stopper positioned so as to be inserted into and guided by the guide wall while being caught by and released from the movable rail; and an elastic member disposed in the housing body in the closing direction, the elastic member being elastically coupled to the rotary stopper;

wherein, in a closing operation of the movable rail, the rotary stopper is operable to catch the elastic member so that the rotary stopper is automatically closed by elasticity of elastic force, and when the rotary stopper is positioned in the opening direction, the opening direction of the rotary stopper moves downward along the curved guide portion in a state in which the elastic member stays in a stretched state, so that the movable rail is released from the rotary stopper to enable an opening operation; and wherein the housing body has a through-hole, the linear guide is elastically deformable by an external force, and the through-hole is positioned in a way that, when a downward external force applies to the rotary stopper, the linear guide portion descends through the through-hole of the housing body by elastic deformation.

2. The undermount-type sliding apparatus of claim 1, wherein the rotary stopper comprises:

a guide insert recess in an inner portion thereof, wherein the guide insert recess is inserted into the guide wall such that the guide insert recess is guided by the guide wall, the guide insert recess comprises:

an opening contact surface;

a curved contact surface above the guide wall inserted into the guide insert recess, wherein in an opened state, the opening contact surface is in contact with the linear guide portion, and the curved contact surface corresponds to the curved guide portion so as to come into contact with the curved guide portion; and a closing contact surface below the guide wall inserted into the guide insert recess, the closing contact surface coming into contact with the linear guide portion in a closed state;

whereby, when closing the receptacle, the rotary stopper, which moves in the state in which the guide wall is inserted into the rotary stopper, can be released in response to rotation of the opening contact surface in contact with the linear guide portion and the curved contact surface in contact with the curved guide portion, so that the closing contact surface below moves in contact with a lower portion of the linear guide portion; and whereby, when opening the receptacle, the rotary stopper can be caught in response to rotation of the opening contact surface in contact with the linear guide portion and the curved contact surface in contact with the curved guide portion.

3. The undermount-type sliding apparatus of claim 1, wherein the automatic closing device further comprises an elastic body disposed in the housing body in the closing direction, the elastic body has an elastic member insert space in a lower inner portion, the elastic body being positioned in the elastic member insert space, and an elastic member-fixing recess in one end of the elastic member insert space in the closing direction, the other end of the elastic member being fixed to the elastic member-fixing recess.

4. The undermount-type sliding apparatus of claim 1, wherein the rotary stopper further comprises an elastic member-fixing protrusion protruding from a lower portion of the rotary stopper in the closing direction, the elastic member-fixing protrusion having a protrusion-fixing recess in an inner portion thereof, a portion of the elastic member being fixedly inserted into the elastic member-fixing protrusion; and wherein one end of the elastic member is inserted into the protrusion-fixing recess such that the rotary stopper can be elastically coupled to the elastic member-fixing protrusion.

5. The undermount-type sliding apparatus of claim 1, wherein the rotary stopper has a catching recess in an upper portion thereof and an inclined surface in the opening direction, the inclined surface being inclined from an upper side portion of the rotary stopper to a side surface of the catching recess; and the undermount-type sliding apparatus further comprises a stopping lug disposed on the movable rail, the stopping lug protruding downward such that the stopping lug can be inserted into and caught by a stopper recess, wherein the inclined surface passes by an inclined position to minimize insertion interference when the stopping lug is caught by and coupled to the stopper recess, and the stopping lug is movable along with the movable rail so that the stopping lug is inserted into and released from the stopper recess.

6. The undermount-type sliding apparatus of claim 5, wherein, when the stopping lug comes into contact with the inclined surface, the external force that presses down the rotary stopper body occurs, and the linear guide portion of the guide wall descends due to the elastic deformation, and the stopping lug is coupled to the catching recess via catching.

* * * * *